United States Patent [19]

Gendelman et al.

[11] Patent Number: 4,787,424

[45] Date of Patent: Nov. 29, 1988

[54] METHOD OF INSERTING LOOPS OF CONTINUOUS WEFT THREAD IN A NEEDLE LOOM

[75] Inventors: Mikhail A. Gendelman; Anatoly F. Borodulin; Alexandr V. Vorobiev; Sergei V. Bychkov, all of Klimovsk Moskovskoi oblasti, U.S.S.R.

[73] Assignee: Klimovskoje Spetsialnoje Knostruktorskoje Bjuro Po Projektirovaniju Tkatskogo Oborudovanija, Klimovsk, U.S.S.R.

[21] Appl. No.: 918,928

[22] Filed: Oct. 15, 1986

[51] Int. Cl.[4] ..... D03D 47/02

[52] U.S. Cl. ..... 139/441; 139/435

[58] Field of Search ..... 139/440–448, 139/429, 435

[56] References Cited

U.S. PATENT DOCUMENTS

| | | | |
|---|---|---|---|
| 3,430,664 | 3/1969 | Shimwell | 139/442 |
| 4,173,990 | 11/1979 | Langlois et al. | 139/440 |
| 4,576,208 | 3/1986 | Steiner | 139/429 |

FOREIGN PATENT DOCUMENTS

| | | | |
|---|---|---|---|
| 907096 | 2/1982 | U.S.S.R. | 139/444 |
| 2135342 | 8/1984 | United Kingdom | 139/441 |

OTHER PUBLICATIONS

"Chemical Fibres for Textile Industry", by Eng. Kirhenberger published in the Fed. Rep. of Germany, Aug., 1984, pp. 498–500, FIGS. 1 and 4.

*Primary Examiner*—Harvey C. Hornsby
*Assistant Examiner*—Joseph S. Machuga
*Attorney, Agent, or Firm*—Fleit, Jacobson, Cohn & Price

[57] ABSTRACT

The method of inserting loops of continuous weft thread in a needle loom includes feeding the weft thread through a tubular inserter needle in a stream of air and inserting the weft thread into the shed in continuous loops by reciprocating the needle. The strokes of the needle and the feed the loop weft thread are matched so that the head portion of the loop formed by carrying the weft thread through the shed is positioned in front of the advancing tubular needle in the direction of its working stroke.

1 Claim, 1 Drawing Sheet

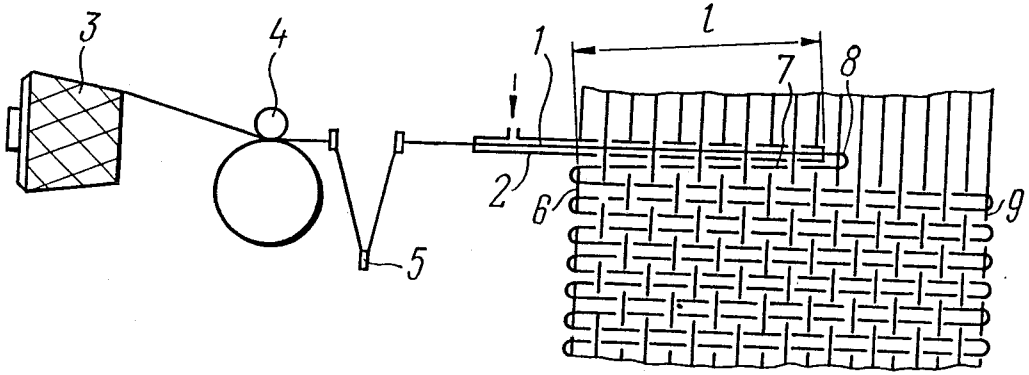
3
4
5
1
2
6
7
8
9
l

METHOD OF INSERTING LOOPS OF CONTINUOUS WEFT THREAD IN A NEEDLE LOOM

FIELD OF THE INVENTION

The present invention relates to textile machines, and more particularly it relates to a method of loops of continuous inserting weft or woof thread in needle looms, also called rapier looms.

BACKGROUND OF THE INVENTION

There is known a method of inserting loops of continuous weft thread, including feeding the weft thread from a supply bobbin into an inserter needle or rapier and inserting the weft thread into the shed by reciprocating the needle or rapier,and securing the loops thus inserted at the front and rear selvages of the cloth being woven, in the direction of the motion of the needle or rapier (see, for example, an article by Eng. Kirhenberger in "Chemical Fibres for Textile Industry" Magazine published in the Federal Republic of Germany, August 1984, pp. 498–500, FIGS. 1 and 4).

According to this method, the weft thread is inserted into the shed by a needle through the eye of which the weft is threaded, the weft thread sliding through the eye of the needle and forming a loop owing to one end of the thread being secured in the selvage and the other end of the thread being pulled off the supply bobbin.

The existence of the friction engagement of the thread with the eye of the needle where the thread changes its direction through about 180° results in the tension of the thread in the alternating runs of the loop (according to Eiler's law) varying at a ratio as high as 2.5:1. This difference in the thread tension can be substantially greater when the thread has such defects as swells, bulges, knots and the like. This leads to an increased weft breakage rate and adversely affects the productivity of the loom. For this reason the above described method would not be practically employed for inserting loops of weft thread across considerable widths of cloth; neither would it be employed for inserting weft thread of relatively low strength.

OBJECTS AND SUMMARY OF THE INVENTION

It is an object of the present invention to provide a method of inserting loops of continuous weft thread in a needle loom, wherein the forming of a continuous loop should be accompanied by a minimized tension applied to the thread being inserted into the shed, without friction against the inserter needle.

It is another object of the present invention is to reduce the breakage rate of the weft thread and to enhance the productivity of a needle loom.

These and other objects are attained by a method of inserting loops of continuous weft thread in a needle loom, including feeding the weft thread from a supply bobbin to the inserter needle and inserting it into the shed in a continuous loop by reciprocating the inserter needle, and securing the head portion of each inserted loop in the selvage of the cloth being woven, in which method, in accordance with the present invention, the weft thread is fed through the tubular inserter needle in a stream of air, the feed of the weft thread through the needle and the strokes of the needle being matched so that the head portion of the loop of the weft thread being carried through the shed is positioned in front of the needle in the direction of its working stroke.

As the inserter needle is being advanced through the shed, the weft thread is being fed or paid out either with the aid of a compensator device, or without a compensator device, directly from a measuring mechanism. The action of the stream of air forms a loop of the weft thread whose head portion is positioned in front of the moving inserter needle as the latter advances through the shed, so that at any moment of the motion of the inserter needle in the shed the length of the thread projecting from the needle exceeds the spacing between the respective entrance selvage of the cloth being woven and the extremity of the inserter needle; moreover, with the runs of the loop being tensioned by the stream of air, the thread would not physically engage the needle. Consequently, the frictional engagement of the thread with the inserter needle is avoided, and the thread is saved from the hazardous mechanical action of the needle. Meanwhile, the tension of the run of the thread being paid off the bobbin is defined exclusively by the characteristics of the air stream, which means that the characteristics of the air stream can be matched to the operating duty of the loom, i.e. its working speed, the kind of yarn used, etc., so as to ensure an optimized tension of the weft thread in each specific case of weaving.

The decision on whether the weft thread should be fed with the aid of a compensator device or directly from a measuring mechanism depends on the kind and characteristics of the yarn used.

BRIEF DESCRIPTION OF THE DRAWING

The invention will be further described in connection with its embodiment, with reference being made to the accompanying FIGURE of drawing illustrating schematically the insertion of the weft thread in a loop by a needle being advanced into the shed.

In accordance with the disclosed method of inserting loops of continuous weft thread 1 in a known per se needle or rapier loom, there is used a known per se tubular needle or rapier 2, and the weft thread 1 is fed through this needle 2 in a stream of compressed air supplied by a compressed-air system (the air supply is indicated by an arrow in the accompanying pneumatic drawing). The weft thread 1 unwound from a stationary supply bobbin 3 passes through a measuring device 4, a compensator 5 and through the needle 2; the weft thread 1 being secured by warp threads at the entrance selvage 6, i.e. at the selvage closer to the supply bobbin 3, and forming a continuous loop 7 of which one run passes through the needle 2 and the other run passes beyond the needle 2 in the shed of the loom (as it can be seen in the appended drawing).

In operation of the loom, the tension is applied to the weft thread 1 in the needle 2 by the stream of compressed air issuing from the needle 2. The feed of the weft thread 1 through the needle 2 and the rate of the insertion stroke of the reciprocating needle 2 are matched in a suitable known per se manner so that the head portion 8 of the loop 7 of the weft thread 1 being carried through the shed is ahead or in front of the needle 2 in the direction of its working or insertion stroke, as it can be seen in the appended drawing; this means that at any moment the length of the thread projecting from the needle 2 is in excess of the spacing "l" of the extremity of the needle 2 from the entrance selvage 6 of the cloth being woven. Owing to the action of the air stream, the loop 7 forming in front of the needle 2 does not physically engage the latter. As the needle 2 reaches the opposite remote selvage 9, the head portion 8 of the loop 7 is retained in any suitable known per se manner and secured at the selvage 9. Then the needle 2 is driven through its return stroke, and the compensator 5 ensures the feed of the weft thread 1 through an amount corresponding to the stroke of the retracting needle 2. Then the inserted loop is beaten up in the known per se manner to the fell of the cloth, and the above described cycle is repeated.

If the feed of the weft thread 1 is effected directly from the metering-out mechanism 4, and the length of the thread to be metered out for a pick is preselected, the law governing the reciprocating motion of the needle 2 is selected so as to ensure that the length of the thread 1 projecting from the needle 2 exceeds the spacing of the extremity of the needle 2 from the entrance selvage 6, i.e. that the head portion 8 of the loop 7 is maintained in front of the needle 2.

The employment of the herein disclosed method provides for bringing down the breakage rate of weft thread inserted in successive continuous loops in a needle loom, and thus for stepping up the productivity of the loom. The method further provides for inserting weft thread in continuous loops across a greater width of cloths being woven, as well as for inserting weft thread of relatively low strength.

What is claimed is:

1. A method of inserting loops of continuous weft thread in a needle loom with the aid of a tubular needle, said method comprising:

feeding a weft thread from a supply bobbin through a tubular needle;

inserting said weft thread into a shed of a loom in a continuous loop by reciprocating the tubular needle and securing a head portion of the inserted loop in a respective selvage of the cloth being woven;

effecting said feeding of said weft thread through the tubular needle in a stream of air; and matching said feeding of said weft thread through the stream of air and the strokes of the tubular needle so that the head portion of the loop being formed by carrying said weft thread through the shed is positioned in front of the tubular needle in the direction of the working stroke thereof spaced from a front end of the tubular needle so that at any moment a length of said weft thread which is projecting from said tubular needle and measured from an extrance selvage is in excess of a spacing between said front end of said tubular needle and said entrance selvage of the cloth being woven.

* * * * *